US009511908B2

(12) United States Patent
Bons et al.

(10) Patent No.: US 9,511,908 B2
(45) Date of Patent: Dec. 6, 2016

(54) VENTED INSERT FOR A LIQUID POUCH FITMENT

(75) Inventors: Joseph Steven Bons, Minneapolis, MN (US); David M. Shoberg, Inver Grove Heights, MN (US); Kenneth Thomas Dobizl, Mounds View, MN (US); Christopher John Opelt, Hampton, MN (US)

(73) Assignee: Ecolab USA Inc., St. Paul, MN (US)

( * ) Notice: Subject to any disclaimer, the term of this patent is extended or adjusted under 35 U.S.C. 154(b) by 1390 days.

(21) Appl. No.: 13/328,752

(22) Filed: Dec. 16, 2011

(65) Prior Publication Data

US 2013/0153592 A1 Jun. 20, 2013

(51) Int. Cl.
*B65D 51/16* (2006.01)

(52) U.S. Cl.
CPC ..... *B65D 51/1616* (2013.01)

(58) Field of Classification Search
CPC ..... Y10T 137/4501; Y10T 137/3099; Y10T 137/053
USPC ..... 220/745, 203.2, 89.1, 303, 360, 366.1,220/367.1, 373, 203.21
See application file for complete search history.

(56) References Cited

U.S. PATENT DOCUMENTS

| | | | | |
|---|---|---|---|---|
| 3,998,255 | A | 12/1976 | Mather et al. | |
| 4,298,358 | A | 11/1981 | Ruschke | |
| 4,325,398 | A * | 4/1982 | Green | F16K 17/366 137/202 |
| 4,512,771 | A | 4/1985 | Norton | |
| 5,171,439 | A | 12/1992 | Vakharia | |
| 5,653,943 | A | 8/1997 | Arnold | |
| 5,988,414 | A | 11/1999 | Schwarz et al. | |
| 6,026,842 | A * | 2/2000 | Gallant | B01D 19/0063 137/197 |
| 7,762,273 | B2 * | 7/2010 | Bottura | F16K 15/042 137/173 |
| 2012/0248110 | A1 * | 10/2012 | Wu | B65D 43/0208 220/203.21 |

FOREIGN PATENT DOCUMENTS

WO WO 2011/112835 A2 9/2011

* cited by examiner

*Primary Examiner* — Anthony Stashick
*Assistant Examiner* — Blaine Neway
(74) *Attorney, Agent, or Firm* — McKee, Voorhees & Sease, PLC

(57) ABSTRACT

A containment system with a vented insert for a fitment is disclosed. The vented insert includes generally a conduit having an inner and opposite outer end with a valve in the conduit movable to a closed position by liquid. The outer end of the conduit includes a liquid impermeable membrane.

20 Claims, 9 Drawing Sheets

VENTED INSERT FOR A LIQUID POUCH FITMENT

BACKGROUND OF THE INVENTION

Field of the Invention

This invention relates generally to a vented insert for a product containment system and more particularly to a vented insert for a fitment in a liquid pouch.

Description of the Prior Art

One type of container used for storing products is a flexible container or pouch. A flexible container or pouch has limitations, particularly when used to store products that require ventilation. For example, peroxide-based cleaners are best stored and used from a container or pouch that includes a ventilation system. Some containers and pouches include a fitment for delivery and dispensing product to and from the container or pouch.

It is therefore desirable to provide a vented insert for a product containment system.

It is further desirable to provide a vented insert compatible with a fitment in a liquid container or pouch.

SUMMARY OF THE INVENTION

In one embodiment, the invention is a vented insert for a liquid pouch fitment. The insert includes a conduit having an inner and opposite outer end, a valve in the conduit movable to a closed position by liquid and a liquid impermeable membrane generally at the outer end of the conduit. In a preferred form, the valve includes a chamber in the conduit with an opening in communication with the outer end which is selectively closeable by a buoyant member, such as a float. The valve also includes a closed position where the buoyant member is positioned in covering relation over the opening in the conduit when the chamber fills with liquid.

In another embodiment, the invention is a vented insert for a liquid pouch fitment. The vented insert includes a generally tapered body having an inner and opposite outer end, a conduit through the body generally between the inner and outer ends, a valve in the conduit between the inner and outer ends, and a liquid impermeable membrane at the outer end of the conduit. The valve is movable between open and closed positions by liquid entering the conduit. In a preferred form of the invention, the vented insert is used in combination with a liquid pouch fitment and the tapered body includes a protuberated portion to retain the insert in the fitment.

In another embodiment, the invention is a product containment system that includes a container configured to hold a liquid product, a fitment coupled to the container, a vented insert in the fitment having a conduit with an inner and opposite outer end, a valve in the conduit movable to a closed position by liquid entering the conduit, and a liquid impermeable membrane at the outer end of the conduit. The liquid impermeable membrane is on located on the outside the container in a preferred form of the invention.

DETAILED DESCRIPTION OF THE PREFERRED EMBODIMENTS

In the following detailed description, reference is made to the accompanying drawings, which form a part hereof, and which is shown by way of illustration specific embodiments in which the invention may be practiced. These embodiments are described in sufficient detail to enable those skilled in the art to practice the invention, and is to be understood that other embodiments may be utilized and that changes may be made without departing from the spirit and scope of the present invention. The following detailed description is, therefore, not to be taken in any limiting sense, and the scope of the present invention is defined only by the claims and equivalence thereof.

Figure 1:
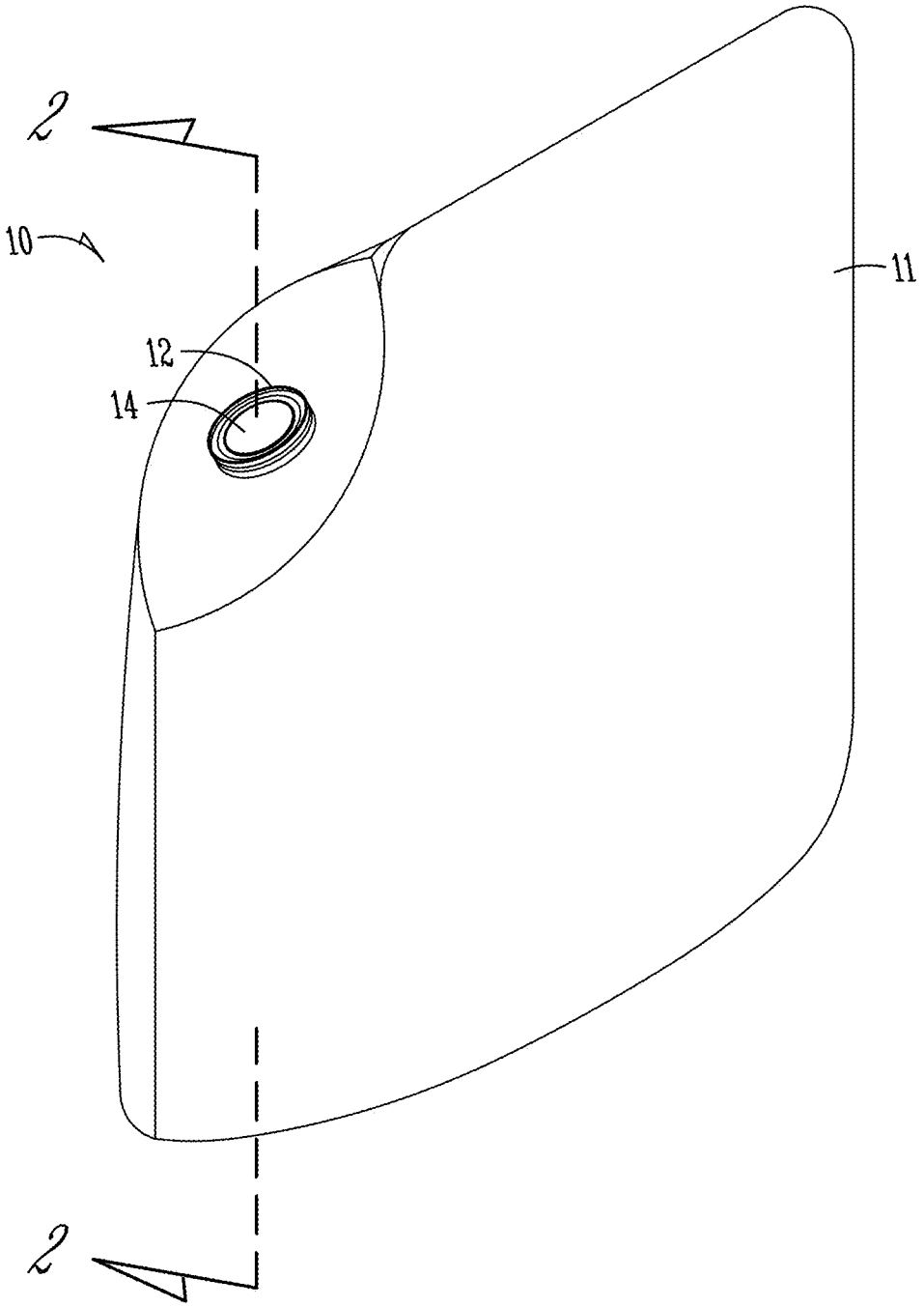
FIG. 1 is a perspective view of a product containment system according to one aspect of the invention.

Embodiments of the present invention provide a vented insert for a product containment system. In particular, embodiments provide a vented insert for a fitment in a liquid pouch or flexible container. Referring to FIG. 1, a perspective view of an exemplary containment system 10 of the present invention is shown. The containment system 10 includes a container body forming an interior volume adapted for holding a liquid product. The container body 11 may be a flexible pouch or flexible container sealed to hold a liquid product. The container body 11 is generally constructed from a plastic bag material, and is therefore flexible, supple and capable of changing shape in accordance with its environment (i.e., packaging, storage and use). The container body 11 may be geometrically configured to suit any desired storage and/or end-use requirements. The container body 11 may include one or more gussets to provide rigidity and stability to the body of the container to enable it to be stood upright or maintain a desired position/orientation. The container body 11 is generally configured to house a liquid product, such as a liquid product that does not require ventilation. The present invention allows the container body 11 to house liquids that exhaust gases, expand/contract or otherwise require ventilation when stored in a plastic pouch or container. In one aspect of the invention, the container body houses a liquid product, such as a peroxide-based cleaner that requires ventilation.

The containment system 10 also includes a fitment 12 to provide a path for delivery and dispensing of product to and from the container body 11. The container body 11 is sealed to the fitment. The containment system 10 may include one or more fitments depending on the orientation/position of the container during storage and/or use. For example, the container may be oriented/positioned one way while being stored and another way while being used. In this instance, the container may be configured with at least one or more fitments where at least one of the fitments is always above the liquid level whether the container is oriented for storage or use. A fitment located in the container body 11 below the level of the liquid in the container may be plugged with an insert, such as a non-vented insert, to keep liquid from leaking or spilling out of the fitment 12. A fitment located above the level of the liquid in the container may be configured with a vented insert 14 to allow the liquid product in the container body 11 to vent.

Figure 2:
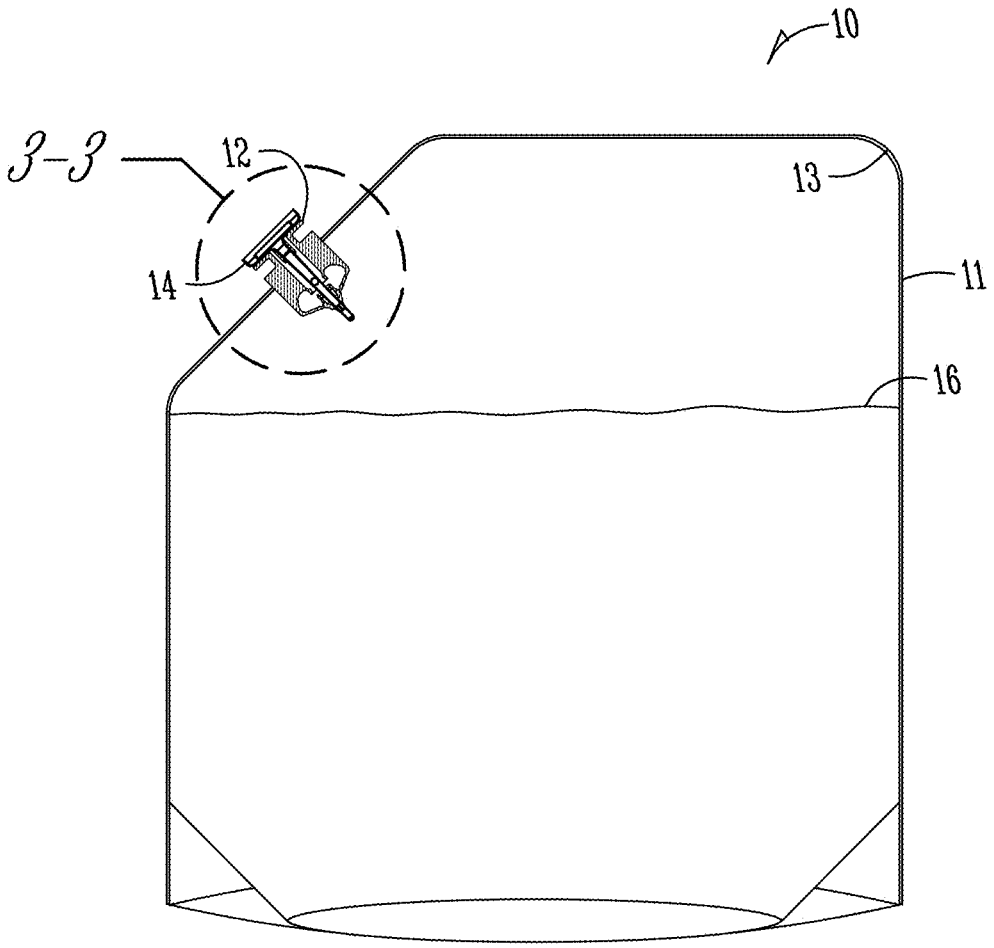
FIG. 2 is a sectional view taken along line 2-2 in FIG. 1.

FIG. 2 illustrates a sectional view of the containment system 10 illustrated in FIG. 1. As shown, the fitment 12 extends through the wall 13 of the container body 11. The wall 13 of the container body 11 is sealed to the outer peripheral surface of the fitment 12 to create a seal about the fitment 12. An outer portion of the fitment 12 resides outside the wall 13 of the container body 11 and an inner portion resides within the container body 11. Preferably, the fitment 12 is positioned at a location on the container body 11 that is generally above the level of the liquid product 16 to prevent the vented insert 14 from wetting out. The containment system 10 may be configured so that depending upon the orientation/position of the container body 11, the fitment 12 with the vented insert 14 remains above the level of the liquid product 16. As addressed above, this could include the container body 11 housing fitments 12 at different locations depending upon the preferred or desired orientation of the container body 11 during storage or use. To the extent a fitment 12 in vented insert 14 resides below the liquid product 16 level, a non-vented insert (i.e., a plug insert) may be inserted into the fitment 12 to seal off the fitment and allow venting to occur through the vented insert 14 and fitment 12 above the liquid product 16 level.

Figure 3:
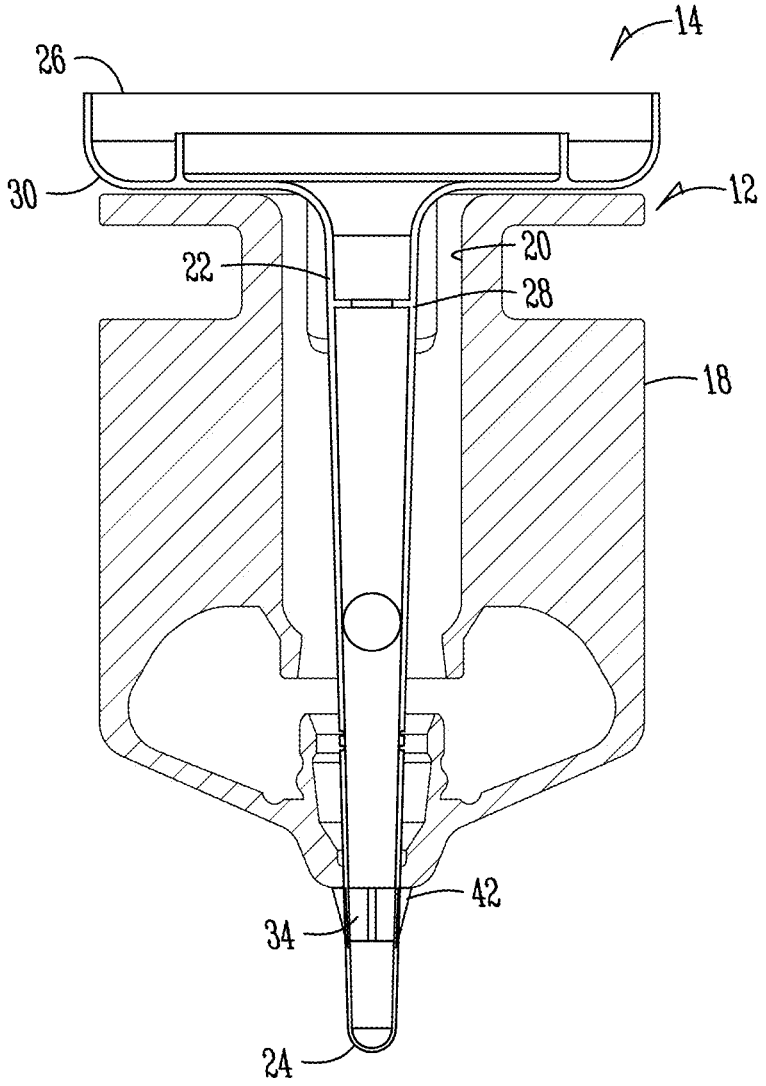
FIG. 3 is an illustration of the vented insert and corresponding fitment taken along line 3-3 in FIG. 2.
Figure 4:
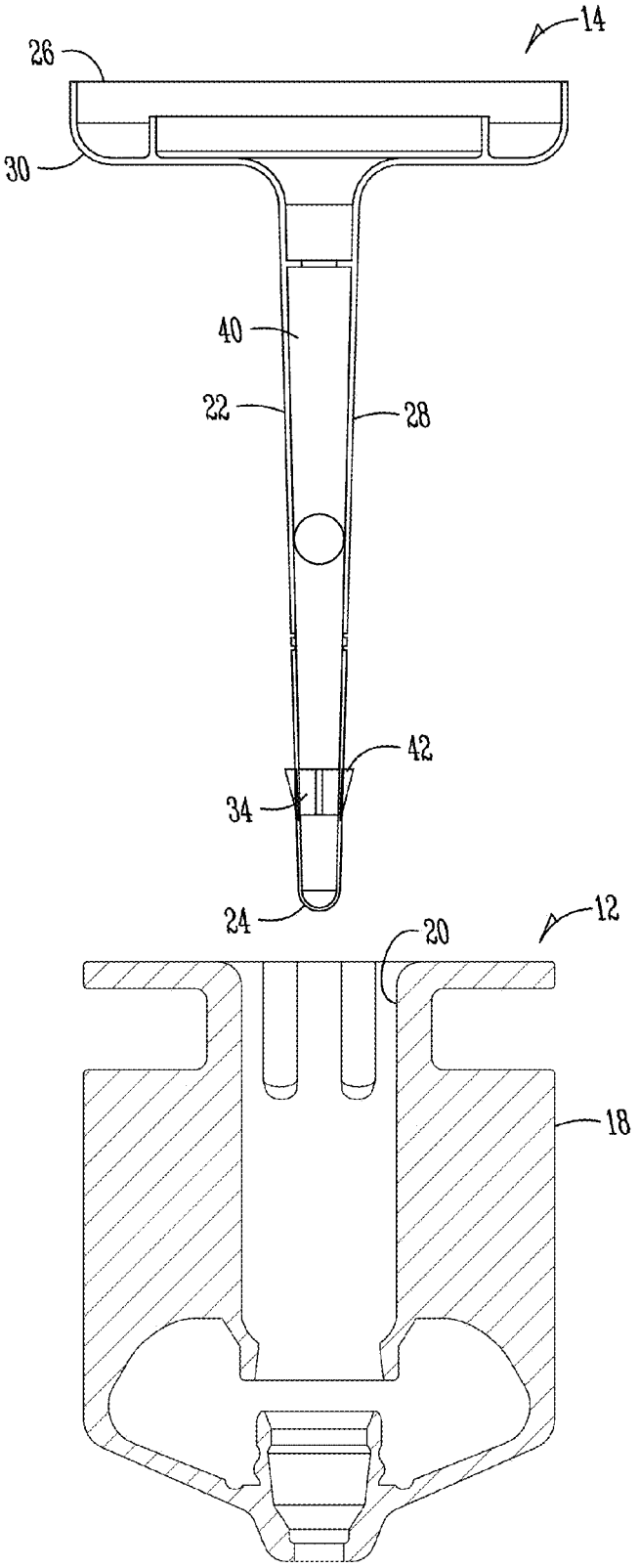
FIG. 4 is an exploded view of the vented insert and corresponding fitment shown in FIG. 3.
Figure 5:
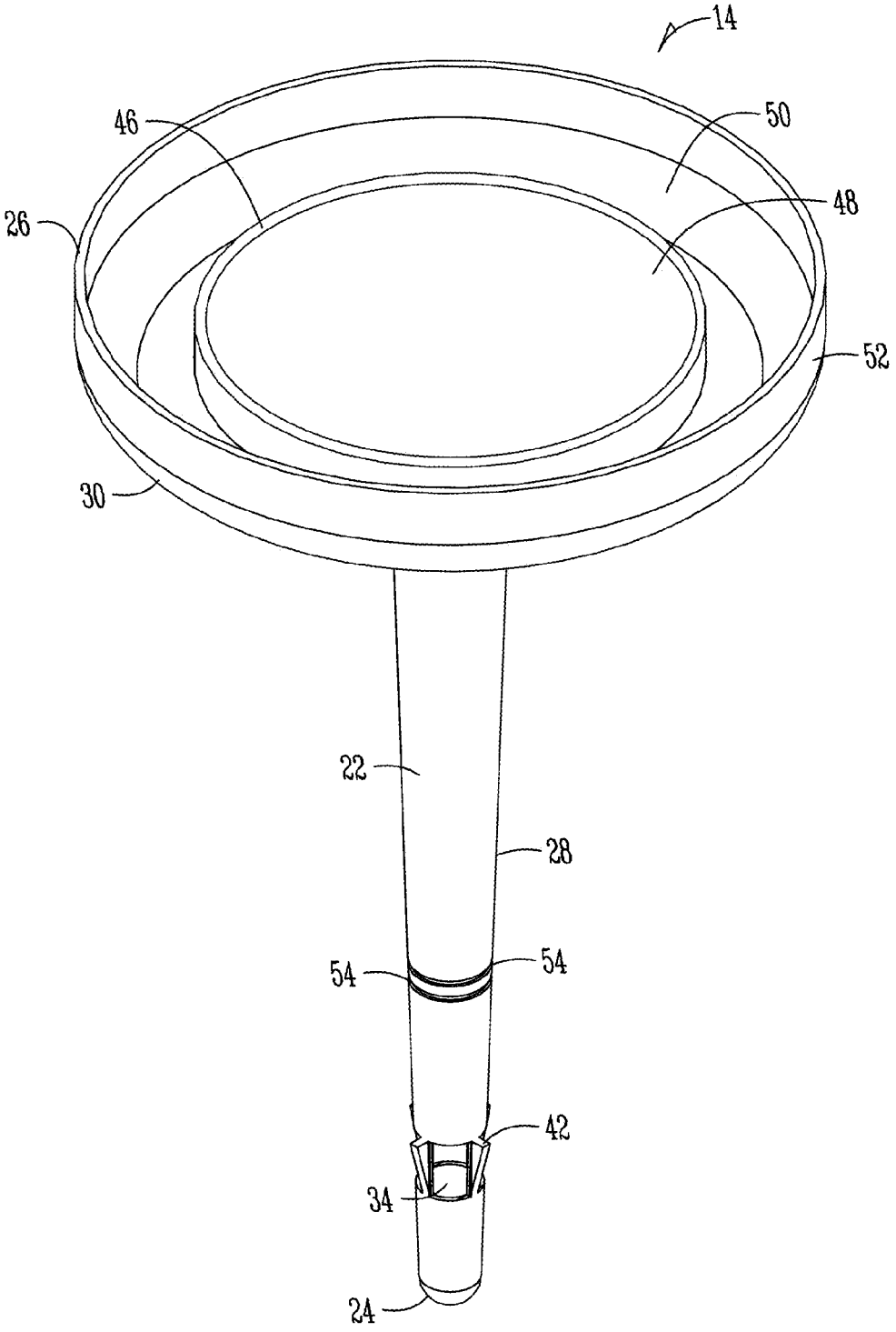
FIG. 5 is a perspective view of a vented insert according to an exemplary aspect of the present invention.

FIGS. 3-4 illustrate the vented insert 14 both received within and separated from the fitment 12 according to one aspect of the present invention. The fitment 12 includes a body 18 with a body passage 20 providing a path for delivery and dispensing of the liquid product 16 to and from the container body 11. In one embodiment of the present invention, fitment 12 is a commercially available fitment acquired, for example, from Innovative Packing Network (IPN USA Corp., 700 Dividend Drive, Suite 500, Peachtree City, Ga.). The fitment 12, as previously discussed, provides a pathway through the wall 13 of container body 11 into the volume within the container body 11. Liquid product 16 within the container body 11 can be dispensed through the fitment 12, and liquid product 16 can be received into the container body 11 through the fitment 12. In both instances, the liquid product 16 may pass through the body passage 20 of fitment 12 unless otherwise sealed by an insert, such as vented insert 14, or another insert such as a plug. As shown in FIG. 3, the elongated portion 30 of the vented insert 14 is received within the body passage 20 in the fitment 12. The vented insert 14 seals off the body passage 20 in the fitment 12 to allow air but prevent liquid from passing through the body passage 20.

As illustrated in FIGS. 3-4 and 5-7, the vented insert 14 includes a body 22 having an enlarged portion 30 at the outer end 26 and an elongated portion 28 extending from the enlarged portion 30 toward the inner end 24. The elongated portion 28 of the vented insert 14 is received within the body passage 20 of the fitment 12 as shown in FIG. 3. When the vented insert 14 is inserted within the body passage 20 of the fitment 12, the body passage 20 is sealed off thereby forcing any communication of liquid or gas from the container body 11 into and/or through the vented insert 14.

Figure 6:
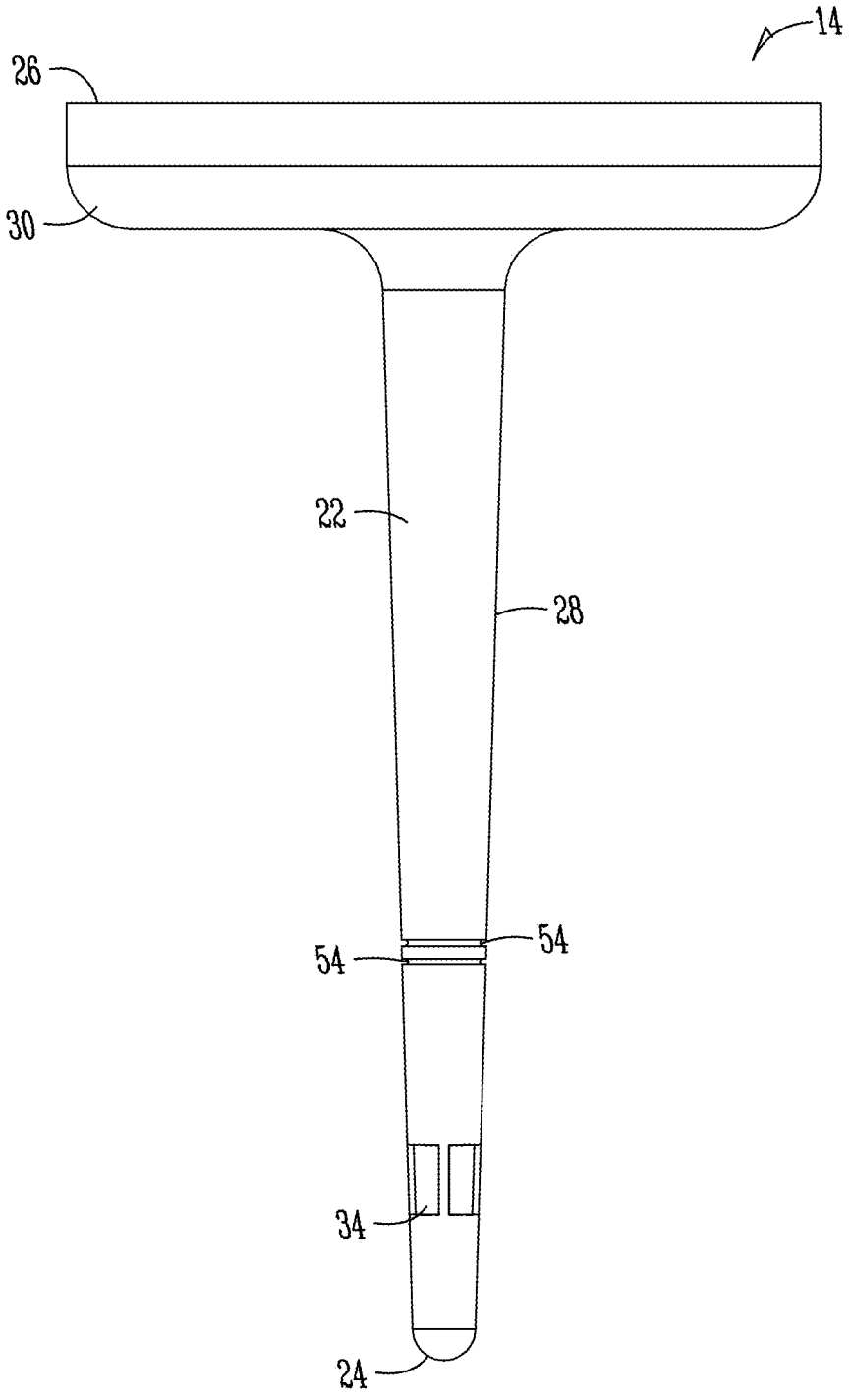
FIG. 6 is a front elevation view of the vented insert shown in FIG. 5.
Figure 7:
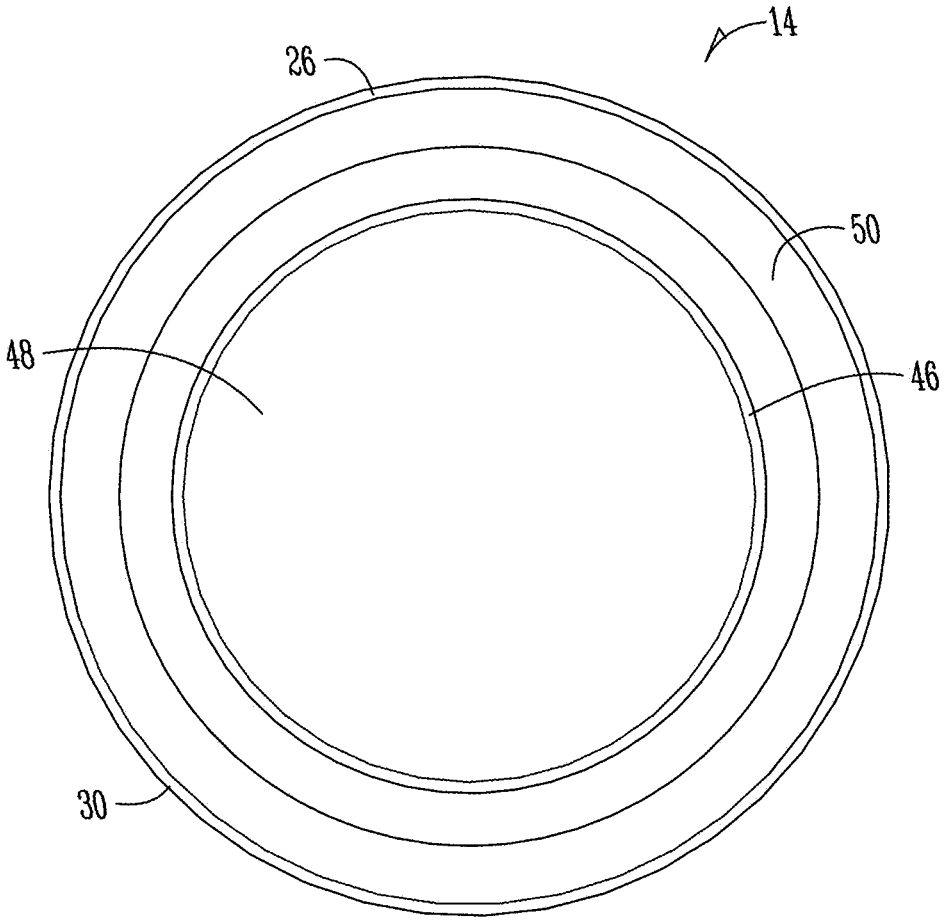
FIG. 7 is a top plan view of the vented insert shown in FIG. 5.

In one aspect of the present invention, the elongated portion 30 of the vented insert 14 includes a protuberated portion 42 that is received in blocking engagement against the body 22 of fitment 12 as shown in FIG. 3 to prevent the vented insert 14 from inadvertently separating from the fitment 12 or being removed. FIG. 6 illustrates an embodiment of the present invention wherein the vented insert 14 includes an elongated portion 28 having a generally tapered body without a protuberated portion 42 to allow the vented insert 14 to be removably received within the body passage 20 of fitment 12. In the instance where the elongated portion 28 of the vented insert 14 includes a protuberated portion 42, the protuberated portion 42 may be configured as one or more geometries that extend out beyond the outer periphery of the elongated portion 30, such as a tapered rib extending radially outward from the elongated portion or a fin extending radially outward from the elongated portion 28 of fitment 12. The protuberated portion 42 may also include other geometries such as a radially arranged rib or bulb along the outer periphery of the elongated portion 28 of the insert 14. The protuberated portion 42 may also be configured into the outer periphery of the elongated portion 28 above and/or below the openings 34 in the elongated portion 28. Since the protuberated portion 42 is received in blocking engagement against the inner end of the body 18 of fitment 12, the vented insert 14 is prevented from becoming dislodged, inadvertently separated or intentionally removed from the fitment 12.

As illustrated in Figures, the vented insert 14 in one aspect of the invention includes an enlarged portion 30 having a circumference greater than the elongated portion 28. The enlarged portion 30 preferably has a circumference at least greater than the circumference of the body passage 20 in the fitment 12. The undersides of the enlarged portion 30 mates generally flush against the outer top surface of the fitment 12 when the vented insert 14 is inserted into the fitment 12. The enlarged portion 30 generally forms the outer end 26 of vented insert 14. The enlarged portion 30 also has an outer circumference with a generally vertical portion 52 that extends in a direction away from the elongated portion 28 to form a recess 50 within which a generally circumferentially shaped rib 46 houses a liquid impermeable membrane 48. The recess 50 may facilitate the capture of any liquid that might escape through or around the liquid impermeable membrane 48. In one aspect of the present invention, the liquid impermeable membrane is configured from expanded Polytetrafluoroethylene (ePTFE). The elongated portion 28 extends from the enlarged portion 30 toward the inner end 24. The elongated portion 28 may be tapered or generally planar. In one aspect, the elongated portion 28 tapers or narrows concentrically from the enlarged portion 30 to the inner end 24 to seat flush against the generally tapered inner wall of the body passage 20 in the fitment 12. The elongated portion 28 may be configured to accommodate the various geometries for the body passage of a number of different types of fitments. The outer surface of the elongated portion 28 may also be configured with a number of radial channels 54 to help grip the body passage 20 in the fitment 12 when the elongated portion 28 is seated in the body passage 20. Furthermore, features such as the radial channels 54 may be configured in the outer surface of the elongated portion 28 to create and interference fit or mate with corresponding features within the body passage 20 of the fitment 12.

Figure 8:
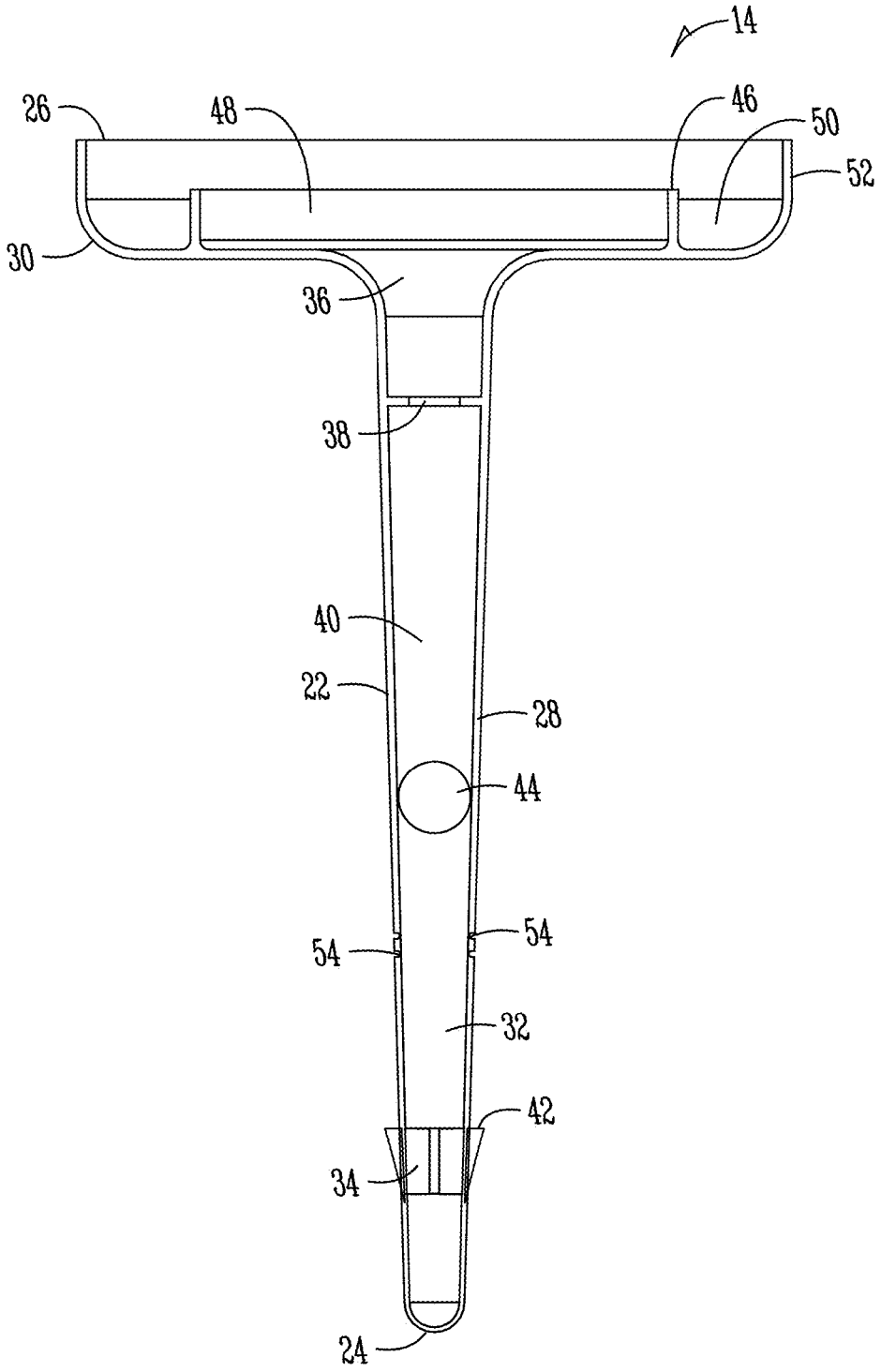
FIG. 8 is a sectional view of vented insert shown in FIG. 4 with the valve in the open position.
Figure 9:
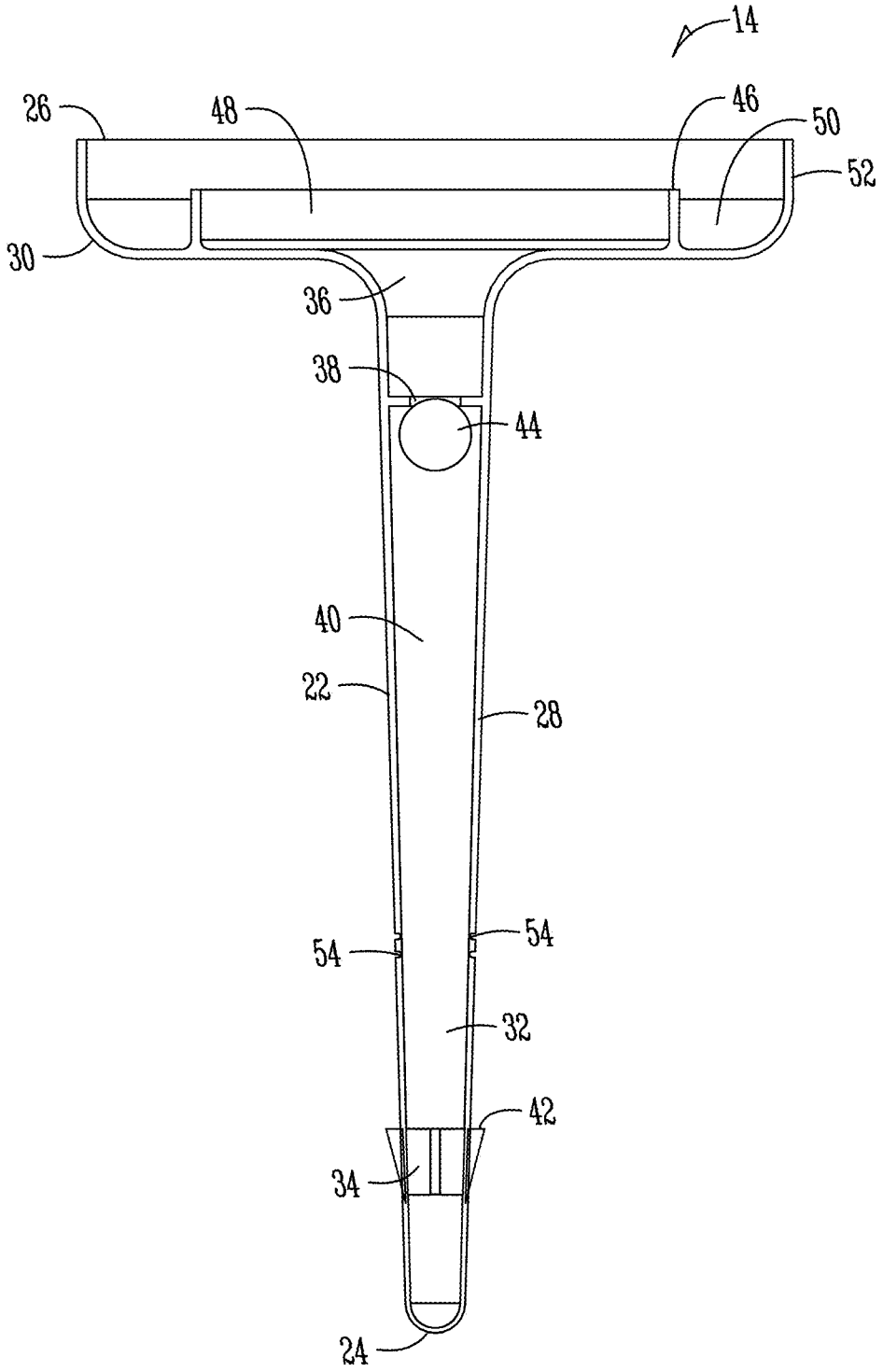
FIG. 9 is another illustration of the vented insert shown in FIG. 4 with the valve in the closed position.

As illustrated in FIGS. 8-9, a conduit 32 having an outlet 36 proximate the liquid impermeable membrane 48 and an inlet 34 generally at the inner end 24 of the vented insert 14 extends through the body 22 of the vented insert 14. The inlet 34 is in communication with the conduit 32 passing through the body 22 of the vented insert 14. A chamber 40 is formed between the inlet 34 and the opening 38 before the outlet 36 in the enlarged portion 30 of the vented insert 14. A buoyant member 44, such as a float, is included within the chamber 40. The buoyant member 44 is generally round and is movable between open and closed positions. In the closed position shown in FIG. 9, the buoyant member 44 is moved into covering relation over the opening 38 of chamber 40 to prevent liquid in the chamber from passing through the opening 38 and out the outlet 36 into contact with the liquid impermeable membrane 48. In the open position shown in FIG. 8, the buoyant member 44 is at a position generally below the opening 38 whereby air and/or gas is allowed to vent from the container body 11 through the conduit 32 and the liquid impermeable membrane 48. Specifically, in the open position shown in FIG. 8, air or gas is permitted to escape from the container body 11 of a containment system 10 by entering into the conduit 32 through openings 34. Once in the conduit 32 the air or gas passes around the buoyant member 44, out the opening 38 and outlet 36. The escaping air or gas leaves the vented insert 14 by finally passing through the liquid impermeable membrane 48. In the instance where liquid enters into the conduit through inlets 34, buoyant member 44 moves into the closed position shown in FIG. 9 to occlude the opening 38 of chamber 40 and thereby prevent liquid from passing through the opening 38, outlet 36 and wetting out the liquid impermeable membrane 48, or otherwise inhibiting ventilation of a gas or air through the membrane 48. When the liquid level in the chamber 40 of conduit 32 drops, the buoyant member 44 also descends to permit air or gas to escape from the container through opening 38, outlet 36 and liquid impermeable membrane 48. The liquid impermeable membrane 48 helps prevent liquid that has escaped the chamber 40 around buoyant member 44 and through opening 38 from leaking out of the vented insert 14 and onto the outside of the container. Thus, the present invention provides both leak prevention in combination with ventilation for liquids within a containment system 10 that require ventilation and that may from time-to-time submerse the fitment 12. The liquid impermeable membrane 48 in combination with the buoyant member 44 provide redundancy for insuring that both ventilation and leak prevention are achieved under various storage and end-use applications for the containment system 10. Also, to the extent liquid passes through opening 38, the liquid trapped between the liquid impermeable membrane 48 and opening 38 when the buoyant member 44 is in the closed position may drain into the chamber 40 and back into the container when the buoyant member 44 moves to the open position shown in FIG. 8.

The above Specification, examples, and data provide a complete description of the manufacturing and use of the composition of the invention. Since many embodiments of the invention can be made without departing from the spirit and scope of the invention, the invention resides in the claims hereinafter appended.

What is claimed is:

1. A vented insert for a fitment of a liquid pouch, the vented insert comprising:

a conduit in a tapered body, said conduit having a conduit inner end opposite a conduit outer end;

a valve located within the conduit movable between an open position and a closed position by liquid; and a liquid impermeable membrane proximate to the conduit outer end;

wherein the vented insert, is configured to be positioned on the liquid pouch relative to the level of liquid within the liquid pouch, said vented insert is positioned above the level of liquid;

an enlarged portion extending from the body outer end, said enlarged portion having a generally circular shape; and a generally vertical portion at an outer edge of the enlarged portion to form a recess;

wherein the recess is configured to capture any liquid that escapes through the liquid impermeable membrane.

2. The vented insert of claim 1 wherein the valve includes a chamber in the conduit with an opening in communication with the conduit outer end selectively closed by a float.

3. The vented insert of claim 2 wherein the valve is in the closed position when the float is positioned in covering relation over the opening in the conduit when the chamber fills with liquid.

4. The vented insert of claim 2 wherein the valve is in the open position when the float is positioned generally between the opening and the conduit inner end.

5. The vented insert of claim 1 wherein the tapered body further comprising a body encompassing the conduit and comprising a body outer end and a body inner end, said body comprising an elongated portion extending from the conduit outer end to the conduit inner end.

6. The vented insert of claim 5 wherein the elongated portion of the body includes one or more protuberated portions extending outward from the body between the body outer end and the body inner end, said one or more protuberated portions adapted to prevent removal of the vented insert from the fitment.

7. The vented insert of claim 5 wherein the elongated portion of the body is generally tapered.

8. A vented insert for a liquid pouch fitment, comprising:

a generally tapered body having a body inner end opposite a body outer end;

a conduit through the body generally between the body inner end and the body outer end;

a valve in the conduit between the body inner end and the body outer end, the valve movable between open and closed positions by liquid entering the conduit;

a liquid impermeable membrane proximate to the body outer end ;

an enlarged portion extending from the body outer end, said enlarged portion having a generally circular shape; and a generally vertical portion at an outer edge of the enlarged portion to form a recess;

wherein the recess is configured to capture any liquid that escapes through the liquid impermeable membrane.

9. The vented insert of claim 8 in combination with a liquid pouch fitment.

10. The vented insert of claim 8 wherein the liquid impermeable membrane comprises expanded polytetrafluoroethylene (ePTFE).

11. The vented insert of claim 8 wherein the tapered body includes a protuberated portion generally at the inner end.

12. The vented insert of claim 8 wherein the valve is in the closed position when a buoyant member is moved into blocking engagement with the conduit by liquid entering the conduit proximate to the body inner end.

13. The vented insert of claim 8 wherein the valve is in the open position when a buoyant member is separated from blocking engagement with the conduit.

14. A product containment system comprising:

a container configured to hold a liquid product;

a fitment coupled to the container;

a vented insert in the fitment having a conduit with conduit inner end opposite a conduit outer end;

a valve in the conduit movable between an open position and a closed position by liquid entering the conduit;

a liquid impermeable membrane at the conduit outer end;

an enlarged portion extending from the conduit outer end; and a generally vertical portion at an outer edge of the enlarged portion forming a recess;

wherein the recess is configured to capture any liquid that escapes through the liquid impermeable membrane.

15. The product containment system of claim 14 wherein the liquid impermeable membrane is outside the container.

16. The product containment system of claim 14 wherein the fitment includes a body having a body passage into the container.

17. The product containment system of claim 16 wherein the vented insert includes a protuberated portion generally near the conduit inner end in locking engagement with the body passage.

18. The product containment system of claim 14 wherein the valve is inside the container.

19. The product containment system of claim 14 wherein a buoyant member in the valve moves to the closed position in response to liquid entering the conduit.

20. The product containment system of claim 14 wherein a buoyant member in the valve moves to the open position in response to liquid being absent from the conduit.

* * * * *